US008225433B2

(12) United States Patent
Phizackerley

(10) Patent No.: US 8,225,433 B2
(45) Date of Patent: Jul. 24, 2012

(54) APPARATUS FOR MINIMISING ENTANGLEMENT AND BUNCHING OF AN ELONGATE MEANS

(76) Inventor: Murray John Phizackerley, Auckland (NZ)

( * ) Notice: Subject to any disclaimer, the term of this patent is extended or adjusted under 35 U.S.C. 154(b) by 1190 days.

(21) Appl. No.: 11/664,687

(22) PCT Filed: Oct. 4, 2005

(86) PCT No.: PCT/NZ2005/000256

§ 371 (c)(1),
(2), (4) Date: Apr. 5, 2007

(87) PCT Pub. No.: WO2006/052149

PCT Pub. Date: May 18, 2006

(65) Prior Publication Data

US 2007/0256230 A1 Nov. 8, 2007

(30) Foreign Application Priority Data

Oct. 5, 2004 (NZ) ..... 535752
Oct. 18, 2004 (NZ) ..... 535998

(51) Int. Cl.
*E04H 4/00* (2006.01)

(52) U.S. Cl. ..... 4/502; 4/496

(58) Field of Classification Search ..... 4/502
See application file for complete search history.

(56) References Cited

U.S. PATENT DOCUMENTS

| | | | | |
|---|---|---|---|---|
| 3,979,782 | A | 9/1976 | Lamb | |
| 3,982,286 | A | 9/1976 | Foster | |
| 4,001,900 | A | 1/1977 | Lamb | |
| 4,459,711 | A | 7/1984 | Sartain et al. | |
| 4,464,801 | A | 8/1984 | Lamb | |
| 4,466,143 | A | 8/1984 | Lamb | |
| 4,494,256 | A | 1/1985 | Radtke et al. | |
| 4,515,329 | A * | 5/1985 | Sandvik | 242/157.1 |
| 4,815,152 | A * | 3/1989 | MacDonald et al. | 4/502 |
| 4,858,253 | A * | 8/1989 | Lamb | 4/502 |
| 5,044,022 | A | 9/1991 | Hess | |
| 5,105,481 | A * | 4/1992 | Lamb et al. | 4/502 |
| 5,913,613 | A | 6/1999 | Ragsdale et al. | |
| 5,920,922 | A | 7/1999 | Ragsdale et al. | |
| 6,026,522 | A * | 2/2000 | Last | 4/502 |
| 6,384,726 | B1 * | 5/2002 | Epple et al. | 340/567 |
| 6,595,495 | B1 | 7/2003 | Hung | |
| 7,325,259 | B2 * | 2/2008 | Wood | 4/502 |
| 2003/0084502 | A1 * | 5/2003 | Epple et al. | 4/502 |
| 2005/0183196 | A1 * | 8/2005 | Smith | 4/502 |

FOREIGN PATENT DOCUMENTS

| | | |
|---|---|---|
| FR | 2292904 | 7/1976 |
| SU | 664899 | 5/1979 |
| WO | WO 89/12151 | 12/1989 |

* cited by examiner

*Primary Examiner* — Gregory Huson
*Assistant Examiner* — Karen L Younkins
(74) *Attorney, Agent, or Firm* — Young & Thompson

(57) ABSTRACT

An apparatus and method for minimizing entanglement and bunching of a retracting or extending cable (10, 11) for a swimming pool cover, comprises a shaft (4) with a roller (5, 6) to guide the cable. The roller slidably rotates on the shaft so that it rotates and moves axially in response to any forces provided by the cable when being retracted or extended, to minimize entanglement and bunching.

18 Claims, 5 Drawing Sheets

APPARATUS FOR MINIMISING ENTANGLEMENT AND BUNCHING OF AN ELONGATE MEANS

TECHNICAL FIELD

The invention relates to an apparatus for minimising bunching and tangling in elongate means. The invention is directed particularly but not solely towards an apparatus and method for minimising bunching and tangling of cables or ropes. This specification can be read in conjunction with NZ 535752 and NZ 535998.

BACKGROUND OF THE INVENTION

An elongate means can be for example wire, rope or cabling which can be manually or mechanically attached to a cover. The elongate means can be arranged to enable automatic and mechanical retraction and extension of the cable and attached cover.

Normally for a standard cover there are two separate cables for each side of a length of the cover. Each cable is part of a retracting/extending mechanism. As there are more than two cables, it is important to keep the tension on the cables the same. If for any reason the tension is not the same, then existing cover retraction/extension mechanisms have problems with cable tangling or bunching on a spool thereby causing uneven forces on the cover which are exemplified by twisting and uneven retraction and extension. This can cause the mechanism to jam. Any jamming requires specialised repair if the cover has not been adequately retracted. Existing anti-jamming devices are complicated having many parts requiring specialized repair and maintenance.

If a cover has not been or can be fully extended this can also cause safety issues in terms of unwanted pool use or accidental drowning. If the cover can not be retracted then the pool can not be used or properly maintained. Additionally, any uneven tension of the cables can cause strain on other parts of any pool cover retracting/extending mechanism. This can also add to the cost and hassle to home owners and regulatory agencies.

OBJECT OF THE INVENTION

It is therefore an object of the invention to provide an improved apparatus to minimise entanglement and bunching of an elongate means which ameliorates at least some of the aforementioned problems and/or provide the public with a useful choice.

STATEMENT OF THE INVENTION

In a first aspect the invention consists in an apparatus for minimising entanglement and bunching of a retracting or extending elongate means, the apparatus comprising a support means and moving means, the moving means is adapted and constructed to allow the elongate means to be movably supported thereon, moving means are rotatably supported by the support means and are adapted to slideably rotate on the support means in response to any forces provided by the elongate means when being retracted or extended, to minimise entanglement and bunching.

Preferably the apparatus provides even tension in the elongate means.

Preferably the moving means include at least one roller.

Preferably the support means includes a first shaft having a length.

Preferably each moving means roller is able to move parallel and perpendicular to the length of the first shaft.

Preferably the moving means rollers are shaped to allow the elongate means on each roller to be slideably supported thereon.

Preferably each moving means roller includes a first groove which is constructed and adapted to slidably support the elongate means.

Preferably the first shaft can be operatively connected to a retraction and extension mechanism.

Preferably the apparatus includes a guard or flexible elongate means retainer which is operatively joined to the apparatus such that the elongate means is not able to jump from the groove of each roller.

Preferably the retainer includes a shaft attaching portion and holding portion wherein the attaching portion is adapted to be removably attached to the first shaft.

Preferably the retainer shaft attaching portion includes an apertured portion allowing the first shaft therethrough and the holding portion is an elongate member able to cover each groove and capture without restricting the movement of the elongate means therebetween.

Preferably the apparatus shaft has attachment means to enable attachment to an extending and retracting mechanism.

Preferably the apparatus includes sensors attached thereon and operatively connected to the motor such that the cover can be automatically retracted or extended in response to any selected parameter e.g. time period, heat or movement, etc.

Accordingly in a second aspect the invention may broadly be said to consist in an extending and retracting mechanism for an elongate means for a cover, the mechanism including a support frame, activation means and an apparatus for minimising entanglement and bunching of the elongate means, as disclosed previously wherein the frame connectively supports the bunching and entanglement minimising means such that no tangling or bunching occurs in the elongate means.

Preferably there is provided the elongate retracting/extending means which includes a second shaft rotatably supporting at least two pulleys.

Preferably the second shaft is connected to the support frame.

Preferably the activation means includes a motor operatively connected to the shaft to cause the shaft to rotate in a clockwise and anticlockwise direction.

Preferably an operating means provides the means to operate wherein the means to operate can be electricity or pneumatics or hydraulics.

Preferably there is provided a guide means which includes a guide support member and guide member wherein the guide members are rotatably supported rollers which are sized and positioned to guide the elongate means from the cover to the guide members through to the apparatus for minimising entanglement and bunching and onto the pulley(s).

Preferably the guide means is connected to the support frame.

Preferably the guide means includes at least one grooved, horizontally oriented roller.

Preferably the guide means includes a guard portion wherein the guide portion includes an elongate member and connection means which elongate member in use covers the elongate means when being slidably supported therebetween and the connection means is supportively connected to the support frame.

Accordingly in another aspect of the invention there is a method of inserting a cable via the apparatus 1 to minimise tangling and bunching, the method including feeding the cable(s) via a guide and then through the retracting and extending apparatus followed by going through and being supported by the apparatus and back to the cover.

BRIEF DESCRIPTION OF DRAWINGS

Embodiments of the invention will now be described by way of example only, with reference to the accompanying drawings of which.

DESCRIPTION OF THE INVENTION

Figure 1:
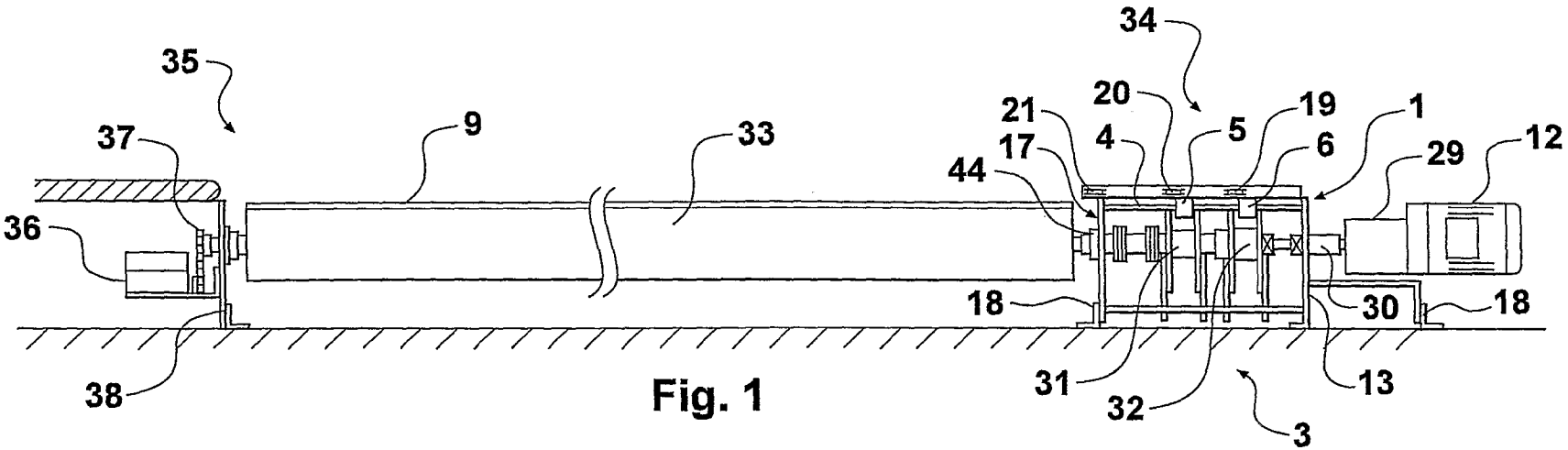
FIG. 1 is a side view of the apparatus for minimising entanglement and bunching of the elongate means with a retracting/extending mechanism.

FIGS. 1-9 show an apparatus 1 for minimising bunching or entanglement of any elongate means (unit) 2 which can be used in combination with a retracting and extending mechanism 3 which can retrofitted or made in combination therewith.

Apparatus 1 for minimising bunching or entanglement includes a support means (unit) and moving means (unit). The support means can include at least one first shaft 4 having a length and defining a first rotating axis. The moving means (unit) includes at least one or two rollers 5 & 6. First shaft 4 is adapted to be stationary and rollers 5 & 6 are adapted to be rotatably supported by shaft 4 such that in use, the rollers 5 & 6 are able to slideably move about the shaft axis parallel to the length, in response to movement of the elongate means 2.

Figure 7:
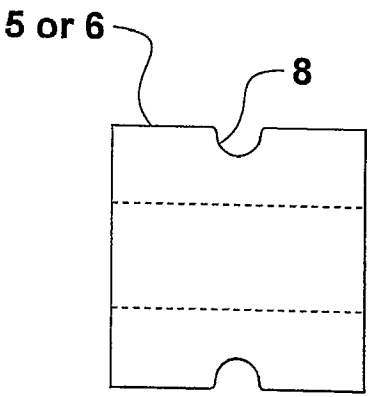
FIG. 7 is an end view of the roller of FIG. 6.
Figure 6:
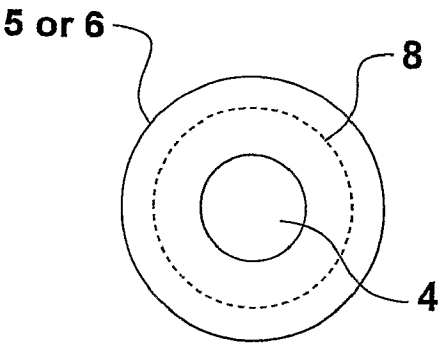
FIG. 6 is a cross sectional view of a roller of the apparatus for minimising entanglement and bunching of the elongate means.

Each roller 5 & 6 as shown in FIGS. 6 & 7 includes a groove portion that can be circumferential groove 8 being adapted and constructed to receive and guide an elongate means (unit). Groove 8 can be at least part way circumferential in extent.

The elongate means (unit) 2 can be any type of elongate means that enables an object to be pulled/retracted or extended. Typically elongate means can be a cable or wire or rope and the object to be pulled or extended can be a cover 9 such as a pool cover or an awning for a building/shelter. In this example the elongate means can be a flexible elongate means (unit) in the form of a cable or rope attachable to the cover as two separate lengths 10 and 11.

The apparatus 1 for minimising bunching or entanglement can be attached to any retractable or extendable mechanised cover system 3. Typically cover 9 can be rectangular in shape having sides and ends. Other cover shapes are equally possible. Each side of the cover can have at least one cable 10 and 11 attached to each side of the cover such that there are two separate cable lengths.

The apparatus 1 for minimising bunching or entanglement as described is adapted to be retro-fitted or combined with an existing retractable and extending cover mechanism 3. Apparatus 1 can be sold as a kit for ready attachment by way of attachment means. The retractable and extending cover mechanism 3 can include an activating means 12, support 13, a cable retracting means and extending means and locating means 15.

Activating means (unit) 12 can comprise a motor or similar with the operating means (unit) being any system that can operate the motor. For example this can be electricity, both mains or portable, a fuel based system, solar or wind or hydraulics or pneumatics system.

Support 13 can include any suitable structure like for example a housing 16 having a frame 17 and bracketing 18 which can be suitably removably connected together in any shape or dimensions as required.

Figure 2:
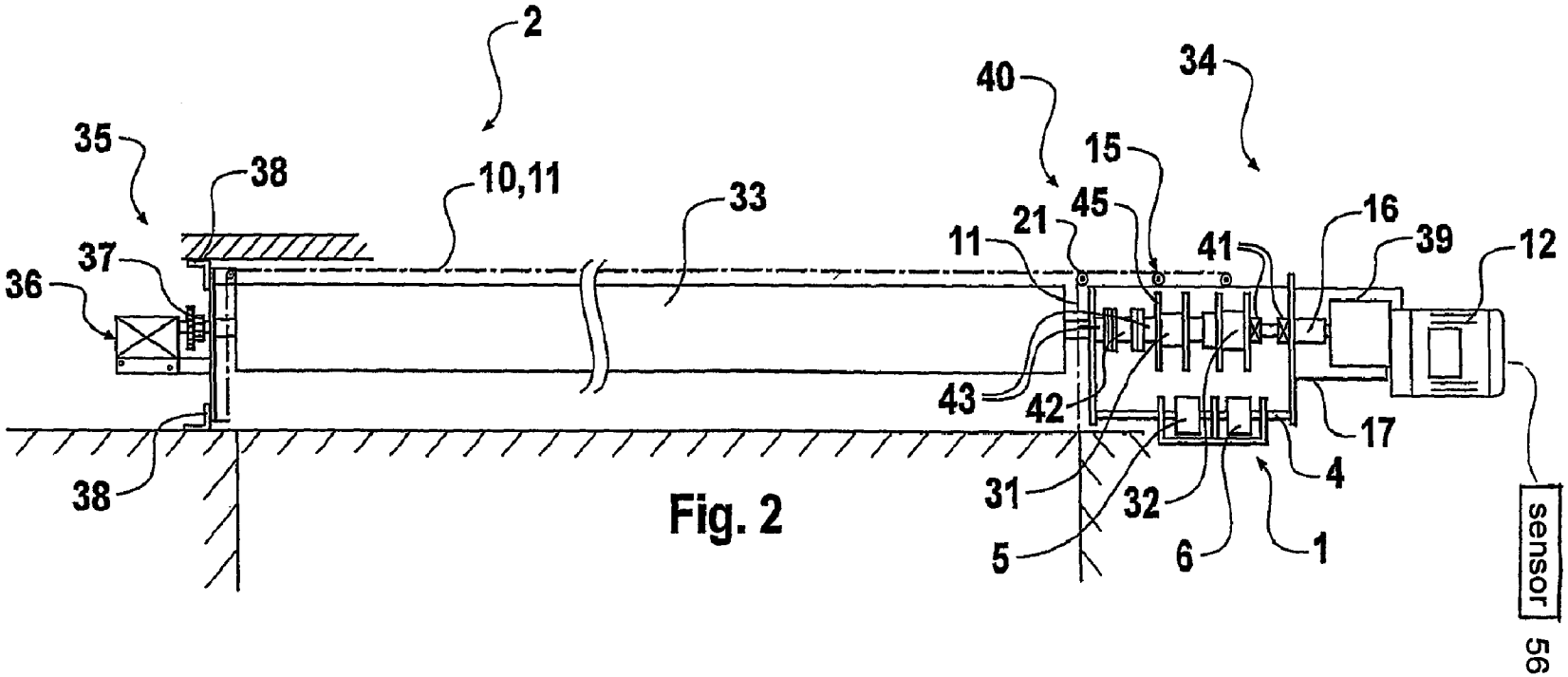
FIG. 2 is a plan view of the apparatus and mechanism of FIG. 1.

Locating means 15 includes at least one guide roller (19, 20, 21) rotatable fixedly mounted on separate support shafts (not shown) which is not rotatable but in other options may be rotatable. FIGS. 1 and 2 show the cable guide having for example three rollers 19-21. The cable retractable and extendable mechanism 3 includes a driving shaft 30 having at least two pulleys 31 & 32 mounted thereon.

Other features can also be included with the mechanism 3 such as a drum 33 mounted on the drive shaft 30 for the cover or covers 9. The drive shaft 30 having a motor end 34 and non motor end 35. An electrical limit switch 36 with chain sprocket 37 can be located at the non motor end 35 of the drive shaft 30. There can also be fixing brackets 38 to support the non motor end of the drive shaft 30.

Figure 3:
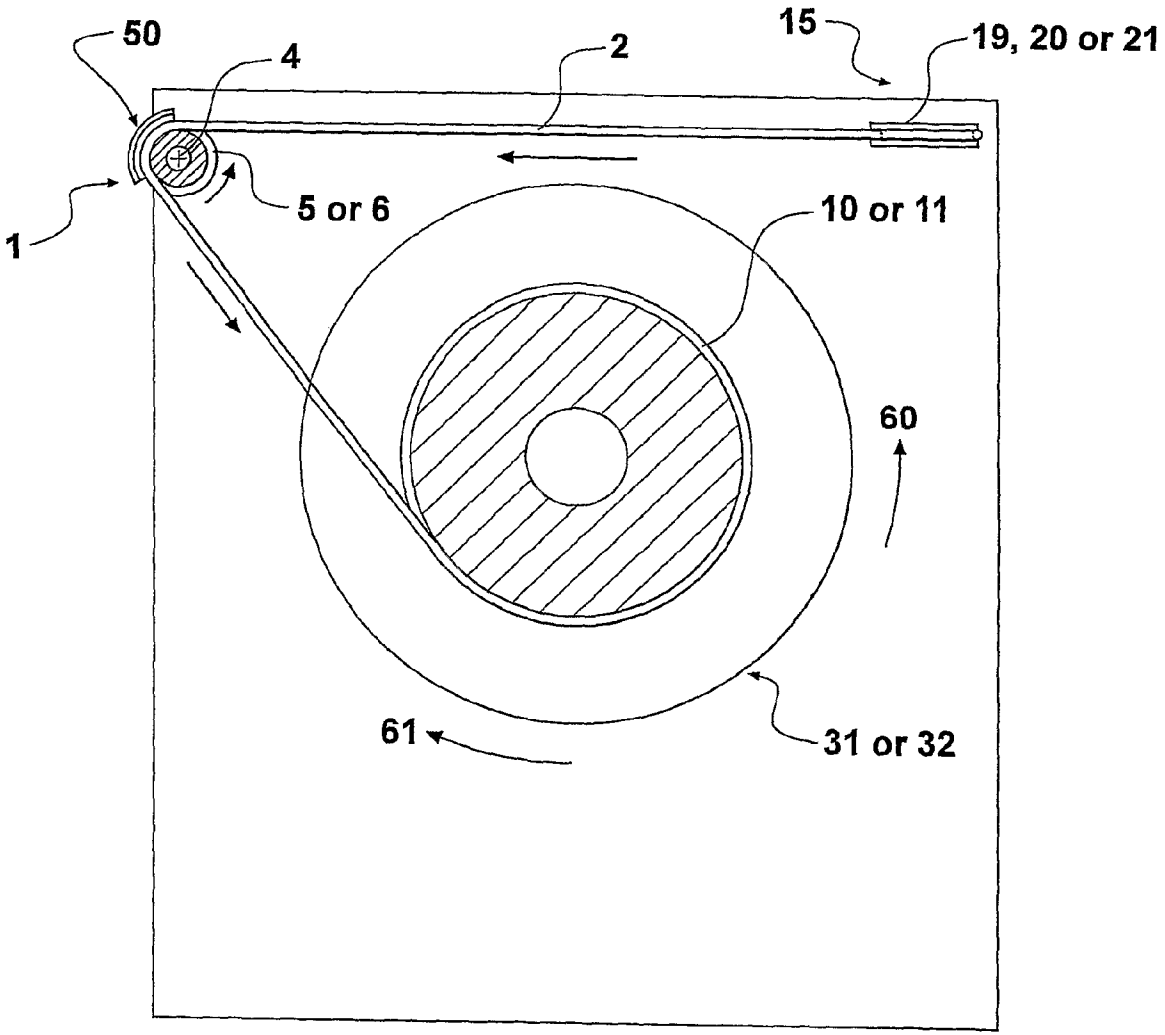
FIG. 3 is a close up schematic cross sectional view of the apparatus and mechanism of FIG. 1.
Figure 5:
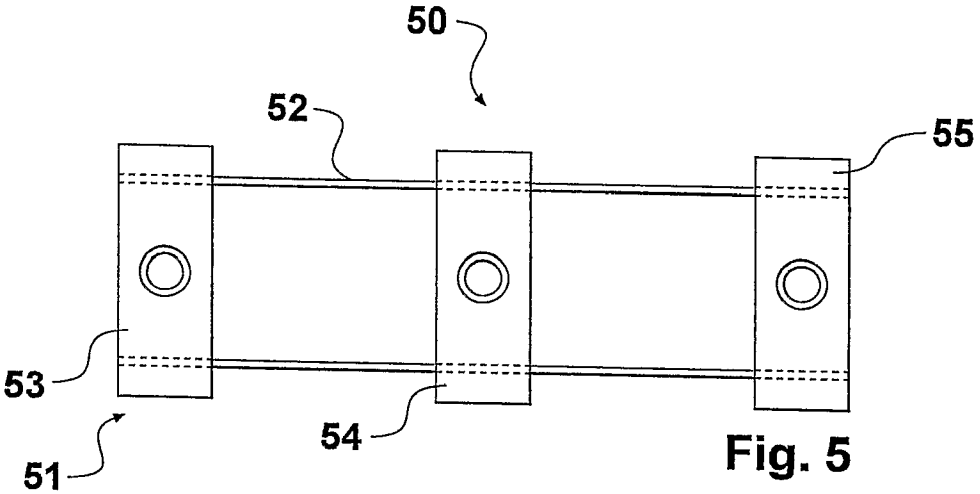
FIG. 5 is a side view of the rope retainer.
Figure 4:
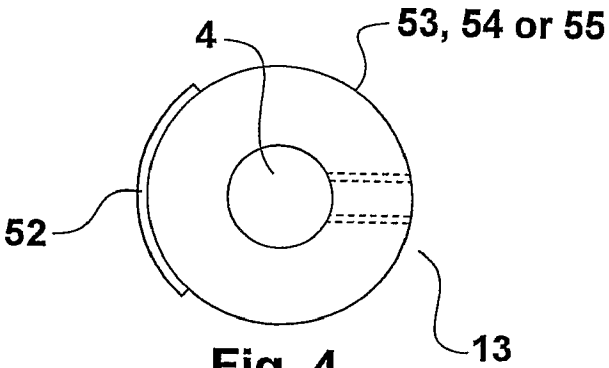
FIG. 4 is a cross sectional view of a roller for the rope retainer.
Figure 8:
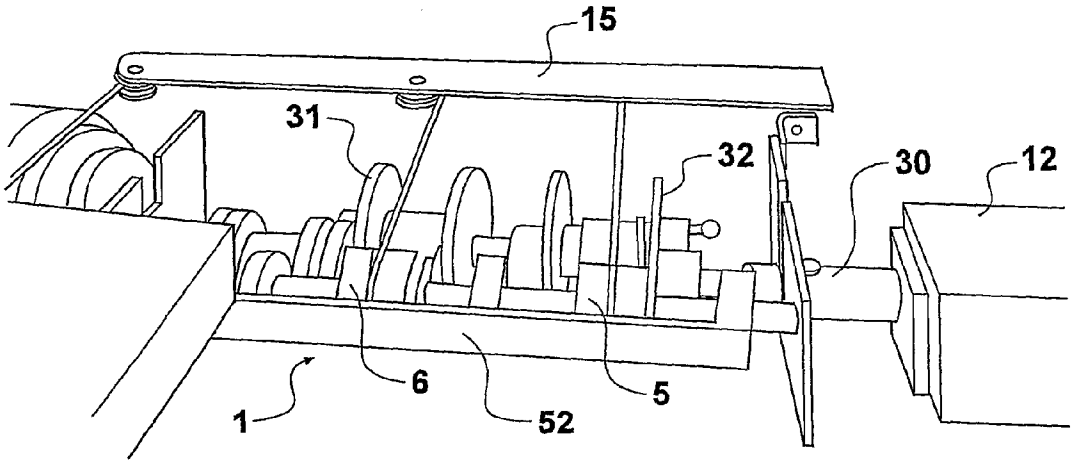
FIGS. 8 and 9 are perspective close up views of the apparatus in place.
Figure 9:
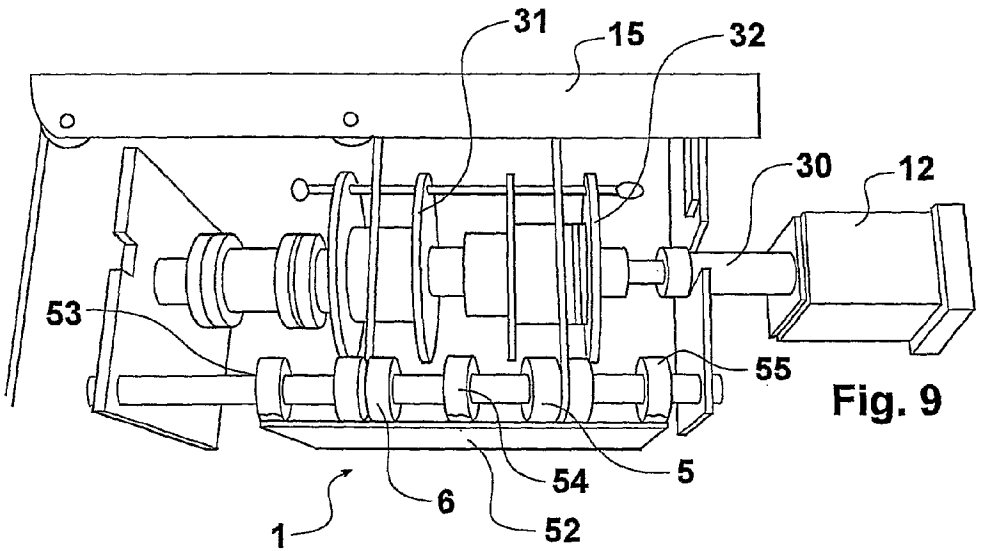

At the motor end 34 of the drive shaft 30 the motor 12 can be operatively connected to a gear box 39, which is operatively connected to a housing 40 having within, locking collars 41, cable pulleys 31, 32, a 3-pin male dog clutch 42 and 3-pin female dog clutch 43 being operatively connected to the apparatus for minimising bunching and entanglement of elongate means 1 or a rope retainer (see FIGS. 3, 4 and 5). Other parts or components can be included as is necessary to enable the drive shaft to work such as bearings 44 and drums 45.

The bunching and entangling apparatus shaft 4 can also be positioned parallel to the other drive shaft 20 placing the apparatus 1 on the side of the housing and guide means being positioned on top of the housing.

In use the cable has a distal end when compared to the apparatus which is removably anchored to the distal end of the cover. The size of the cover can also have slideable attachment means to the cable—not shown.

The proximal cable end can be located on each pulley via and in consecutive order through each guide roller through to the bunching entanglement apparatus roller through to a respective adjacent pulley. The pulley can be activated by activating the motor which rotates the pulley drive shaft in either a clockwise or anti-clockwise direction. Normally both pulleys will be activated to rotate in a similar direction such that the cable and hence the cover can either be retracted or extended.

In another aspect of the mechanism the distal end of the cable can have a further roller support device (not shown) which enables the cover to slideably move either in a retracted or extending orientation by virtue or roller supports that are supported by the sides of a pool if it is a pool cover or by a tracking system (not shown) if we are using the apparatus in an awning.

In other variations there can be extra rollers per shaft if the cover is of certain dimensions. Also the mechanism or the apparatus can have further framing parts that enable shafts to be correctly supported while not moving. There can also be further devices which enable the apparatus to be remotely controlled through wire or wireless operation. The apparatus is also designed to be retrofitted to existing retracting and extendable pool cover mechanisms. The rollers can be made from any suitable material such as nylon or Teflon.

Apparatus 1 for minimising bunching and or entanglement as shown in FIGS. 4 and 5 includes a guard structure or rope retainer 50 that can be used to movably hold elongate means 2 in groove 8 for each and or both rollers. This is especially important when the elongate means is not in tension when being retracted or extended though equally at any other point whenever the elongate means is in tension.

The guard or rope or elongate means retainer 50 includes a shaft attaching portion 51 and holding portion 52. Attaching portion 51 can have apertures shaped to receive shaft 4. Holding portion 42 can include an elongate portion shaped to be able to cover groove 8 of each roller 5 and or 6. For example holding portion 52 can be a strip or angled or elongate member and attaching portion 51 can be at least one ring shaped members 53, 54 and 55. Other means of attachment to the shaft are equally possible as long as the elongate means is held in place in the groove 8. The strip member can be curved as shown in FIG. 4, to match the outer surface of the roller 5 or 6 and rings 53, 54 and 55 and better hold the elongate means in place. The strip member can be affixed to the rings both removably or permanently by welding for example.

The apparatus for minimising bunching and or entanglement can be attached to any other mechanism. The apparatus can be designed to include remote and or automatic control such that the cover can always be automatically extended to provide a safe barrier to unwanted trespassers, thereby negating the need for expensive pool fencing. In this regard the cover can be designed to allow walking thereon. As the apparatus provides minimal entanglement or bunching and an even tension in any extending or retracting of cover cabling, this type of cover is then adapted to be easily and dependably extended or retracted.

The apparatus for minimising bunching and or entanglement can include sensors 56 which serve to facilitate automatic operation, whereby non-use or unwanted use of the pool for a specified time period can be prevented. In operation the apparatus or motor can be initiated to start and extend the pool cover to completely cover the pool or water. This feature enables the pool to always be covered and be an alternative or addition to pool fencing. Additionally security coding can also be used in combination with the apparatus, to further secure the pool against unwanted use. For example, the sensors can be heat or movement activated and can be set up to extend or retract the cover.

In another aspect there is a method of inserting a cable via the apparatus 1 to minimise tangling and bunching. The method may include feeding the cable(s) via a guide and then through the retracting and extending apparatus followed by going through and being supported by the apparatus 1 and back to the cover. Other variations of this method of installation are equally possible such as feeding the cable in a different order as described.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

Throughout the description and claims of this specification the word "comprise" and variations of that word, such as "comprises" and "comprising", are not intended to exclude other additives, components, integers or steps.

The apparatus and method for minimising bunching and or entanglement and/or retracting or extending mechanism can have some of the following advantages:

1. Simple operation.
2. Reduced maintenance.
3. Quick operation.
4. Safe operation.
5. Less likelihood of twisting covers.
6. Retro-fitting is possible.
7. Able to be included in new machines during manufacture.
8. Able to be sold as a kit.
9. Few parts.
10. Modest cost of manufacture.
11. Automatic control.
12. Dependable long life.

I claim:

1. An apparatus for minimizing entanglement and bunching of a retracting or extending elongate unit, the apparatus comprising:

a support unit; and a moving unit, the moving unit being adapted and constructed to allow the flexible elongate unit to be movably supported thereon, said moving unit comprising a plurality of rollers each having at least one groove, said plurality of rollers being rotatably supported by the support unit and adapted to slidably rotate around an outer circumference of the support unit in response to any forces provided by the elongate unit when being retracted or extended, to minimize entanglement and bunching, said apparatus including guide unit including guard or elongate unit retainer such that the elongate unit is not able to jump from the groove of each roller, wherein the support unit includes a first shaft having a length, each roller is in a substantially perpendicular orientation with respect to the first shaft and is able to move parallel to the length of the first shaft, the plurality of rollers are shaped to allow the flexible elongate unit on each roller to be rotatably supported thereon, and the plurality of rollers are slidably supported on the first shaft, the first shaft being stationary.

2. The apparatus for minimizing entanglement and bunching of a retracting or extending elongate unit as claimed in claim 1, wherein the apparatus provides even tension in the elongate unit such that the tension or lack thereof in each elongate unit is substantially the same during extending or retracting.

3. The apparatus for minimizing entanglement and bunching of a retracting or extending elongate unit as claimed in claim 1, wherein each roller includes the groove constructed and adapted to slidably support the flexible elongate unit.

4. The apparatus for minimizing entanglement and bunching of a retracting or extending elongate unit as claimed in claim 3, wherein the first shaft can be operatively connected to a retraction and extension mechanism.

5. The apparatus for minimizing entanglement and bunching of a retracting or extending elongate unit as claimed in claim 4, wherein a retainer includes a shaft attaching portion and a holding portion, wherein the attaching portion is adapted to be removably attached to the first shaft.

6. The apparatus for minimizing entanglement and bunching of a retracting or extending elongate unit as claimed in claim 5, wherein the shaft attaching portion includes an apertured portion allowing the first shaft therethrough, and the holding portion, includes an elongate member able to cover each groove and receive without restricting the movement of the elongate unit.

7. The apparatus for minimizing entanglement and bunching of a retracting or extending elongate unit as claimed in claim 6, wherein the first shaft has attachment unit to enable attachment to an extending and retracting mechanism.

8. The apparatus for minimizing entanglement and bunching of a retracting or extending elongate unit as claimed in claim 7, wherein the apparatus includes sensors attached thereon and operatively connected to the motor such that the cover can be automatically retracted or extended in response to any selected parameter, e.g., time period, heat or movement, etc.

9. The apparatus for minimizing entanglement and bunching of a retracting or extending elongate unit as claimed in claim 8, wherein the elongate unit further comprises a support frame connectively supporting an activation unit.

10. The apparatus for minimizing entanglement and bunching of a retracting or extending elongate unit as claimed in claim 9, wherein the elongate unit further comprises a second shaft or draft shaft rotatably supporting at least two pulleys.

11. The apparatus for minimizing entanglement and bunching of a retracting or extending elongate unit as claimed in claim 10, wherein the second shaft or drive shaft is connected to the support frame.

12. The apparatus for minimizing entanglement and bunching of a retracting or extending elongate unit as claimed in claim 11, wherein the activation unit includes a motor operatively connected to the second shaft to cause the second shaft to rotate in a clockwise direction and an anticlockwise direction.

13. The apparatus for minimizing entanglement and bunching of a retracting or extending elongate unit as claimed in claim 12, wherein an operating unit is operated by one of electricity, pneumatics and hydraulics.

14. The apparatus for minimizing entanglement and bunching of a retracting or extending elongate unit as claimed in claim 13, wherein the guide unit also includes rotatably supported rollers which are sized and positioned to guide the elongate unit from the cover to the rotatably supported rollers through to the grooved rollers and on to the at least two pulleys.

15. The apparatus for minimizing entanglement and bunching of a retracting or extending elongate unit as claimed in claim 14, wherein the guide unit is connected to the support frame.

16. The apparatus for minimizing entanglement and bunching of a retracting or extending elongate unit as claimed in claim 15, wherein the plurality of rollers are horizontally oriented.

17. The apparatus for minimizing entanglement and bunching of a retracting or extending elongate unit as claimed in claim 16, wherein the guard comprises an elongate member and connection which elongate member in use covers the elongate unit when being slidably supported therebetween, and the connection is supportively connected to the support frame.

18. A device for retraction and extension of a cover, the device comprising:

a first shaft;

a plurality of rollers mounted on an outer circumference of the first shaft in a substantially perpendicular orientation with respect to the first shaft and adapted to slidably move parallel to a length of the first shaft, an outer circumference of each of the plurality of rollers having a groove thereon;

a drive shaft mounted parallel to a first shaft;

a plurality of pulleys mounted on the drive shaft;

a rope one of retracts and extends the cover that extend from each of the plurality of pulleys around the groove in a corresponding roller of each of the plurality of rollers, and back to the cover, a motor drives the drive shaft in a direction of retraction or extension, wherein the plurality of rollers rotate around the outer circumference of the first shaft and slide parallel to the length of the first shaft in response to movement of the rope lengthwise and laterally in response to movement of the drive shaft, wherein a retainer is adapted to prevent the rope from jumping out of the groove of each roller of the plurality of rollers in response to movement of the drive shaft.

* * * * *